US008159322B2

(12) United States Patent
Iwasaki et al.

(10) Patent No.: US 8,159,322 B2
(45) Date of Patent: Apr. 17, 2012

(54) LAMINATED COIL

(75) Inventors: Keisuke Iwasaki, Kyoto-fu (JP); Kazuyoshi Uchiyama, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/196,563

(22) Filed: Aug. 2, 2011

(65) Prior Publication Data

US 2012/0032767 A1 Feb. 9, 2012

(30) Foreign Application Priority Data

Aug. 4, 2010 (JP) ..... 2010-175424

(51) Int. Cl.
*H01F 5/00* (2006.01)

(52) U.S. Cl. ..... 336/200

(58) Field of Classification Search ..... 336/65, 336/83, 200, 232, 205–209, 192
See application file for complete search history.

(56) References Cited

U.S. PATENT DOCUMENTS 6,154,114 A * 11/2000 Takahashi ..... 336/200
6,304,164 B1 * 10/2001 Ohno et al. ..... 336/200
2006/0049905 A1 * 3/2006 Maeda et al. ..... 336/200

FOREIGN PATENT DOCUMENTS

JP 2000-133521 A 5/2000
JP 2006-310475 A 11/2006

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

A laminated coil includes a laminated body insulating layers and coil patterns are integrally stacked in a desired order, a coil formed by connecting the coil patterns, a pair of external electrodes provided at opposite ends of the laminated body, and an insulating film provided on an outer peripheral surface of the laminated body. At least one of the coil patterns is in contact with an outer peripheral edge of the corresponding insulating layer at least a part of an outer peripheral edge of the coil pattern, but is not in contact with corners of the insulating layer in a manner such that the at least one coil-pattern is absent at portions of the corresponding insulating layer near the corners of the corresponding insulating layer.

14 Claims, 5 Drawing Sheets

LAMINATED COIL

CROSS REFERENCE TO RELATED APPLICATIONS

The present application claims priority to Japanese Patent Application No. 2010-175424 filed Aug. 4, 2010, the entire contents of which is incorporated herein by reference in its entirety.

FIELD OF THE INVENTION

The present invention relates to a laminated coil, and more particularly, to a laminated coil in which coil patterns have an increased diameter and an insulating film is provided on an outer peripheral surface of a laminated body.

BACKGROUND

Recently, a laminated coil has been frequently used in electric and electronic fields because of its capability of size reduction and excellent mass-productivity. In this laminated coil, a plurality of insulating layers and a plurality of coil patterns are integrally stacked in a desired order. The coil patterns are connected to form a coil in the laminated body. In general, outer peripheral edges of the coil patterns are provided on the inner sides of outer peripheral edges of the insulating layers with a gap being disposed therebetween in a manner such as not to be exposed from an outer peripheral surface of the laminated body. The insulating layers are formed of a magnetic material or a nonmagnetic material.

It is known that the coil characteristic of the laminated coil can be improved by increasing the size of the coil patterns. For example, in a magnetic-core laminated coil including insulating layers formed of a magnetic material, the direct-current superposition characteristic of the coil can be improved by increasing the inner diameter and outer diameter of coil patterns while maintaining the same width of the coil patterns.

In contrast, in an air-core laminated coil including insulating layers formed of a nonmagnetic material, the Q-value of the coil can be increased by increasing the inner diameter and outer diameter of coil patterns while maintaining the same width of the coil patterns.

In the magnetic-core and air-core laminated coils, the direct-current resistance of the coil patterns can be decreased and the Q-value of the coils can be increased by increasing the width (outer diameter) of the coil patterns while maintaining the same inner diameter.

However, when the size of the coil patterns is increased in the laminated coils, the total size of the laminated body increases.

Accordingly, Japanese Unexamined Patent Application Publication No. 2000-133521 proposes a laminated coil that solves the above-described problems. In this laminated coil, the size of coil patterns is increased, but no gap is formed between outer peripheral edges of the coil patterns and outer peripheral edges of insulating layers so as to prevent an increase in the total size of a laminated body. The problem of the coil patterns being exposed from an outer peripheral surface of the laminated body is solved by forming an insulating film made of an insulating resin around the outer peripheral surface of the laminated body.

FIGS. 5 to 7 illustrate a laminated coil 300 disclosed in the above publication. FIG. 5 is a perspective view of the laminated coil 300, FIG. 6A is a cross-sectional view taken along chain line X-X of FIG. 5, FIG. 6B is a cross-sectional view taken along chain line Y-Y of FIG. 5, and FIG. 7 is an exploded perspective view of the laminated coil 300. In FIG. 7, external electrodes and an insulating film are not shown.

As illustrated in FIGS. 5 to 7, the laminated coil 300 includes a laminated body 103 formed by integrally stacking substantially rectangular insulating layers 101, formed of a magnetic material or a nonmagnetic material, and coil patterns 102 in a desired order. The coil patterns 102 have a large diameter, and outer peripheral edges thereof are entirely in contact with outer peripheral edges of the insulating layers 101. That is, there is no gap between the outer peripheral edges of the coil patterns 102 and the outer peripheral edges of the insulating layers 101. Further, the coil patterns 102 are connected by via-hole conductors 104*a* provided through the insulating layers 101, thereby forming a coil 105 in the laminated body 103. No coil patterns 102 are stacked near both ends of the laminated body 103, where a plurality of insulating layers 101 having via-hole conductors 104*b*, through which the coil 105 is led out, are stacked.

A pair of external electrodes 106*a* and 106*b* is provided at opposite ends of the laminated body 103. The external electrode 106*a* is connected to one end of the coil 105, and the external electrode 106*b* is connected to the other end of the coil 105. Further, an insulating film 107 formed of an insulating resin is provided around an outer peripheral surface of the laminated body 103. The insulating film 107 is provided to insulate the outer peripheral edges of the coil patterns 102, which are exposed from the outer peripheral surface of the laminated body 103, from the outside.

In the laminated coil 300 having the above-described structure, when the insulating layers 101 are formed of a magnetic material, the coil 105 is a magnetic-core coil. However, since the outer peripheral edges of the coil patterns 102 reach the outer peripheral surface of the laminated body 103, the coil 105 serves as an open magnetic circuit coil. Therefore, magnetic saturation is unlikely to occur, and the decrease in inductance is suppressed when direct current flows. This improves the direct-current superposition characteristic.

For example, the laminated coil 300 of the related art is produced by the following method.

To produce multiple laminated coils 300 together, a plurality of mother green sheets (not illustrated) are prepared and these serve as bases of insulating layers 101 and are formed of, for example, a ceramic material. Next, via-hole conductors 104*a* or 104*b* for the laminated coils 300 are formed in the mother green sheets, and coil patterns 102 are formed on the mother green sheets as required. For example, the via-hole conductors 104*a* and 104*b* are formed by filling holes preformed in the mother green sheets with conductive paste. For example, the coil patterns 102 are formed by applying conductive paste in a predetermined shape on surfaces of the mother green sheets by screen printing.

Next, the mother green sheets having the predetermined via-hole conductors 104*a* and 104*b* and coil patterns 102 are stacked in a predetermined order, pressed, and fired in a predetermined profile, so that a laminated body block including a plurality of laminated bodies 103 is formed. Then, the laminated body block is cut into a plurality of laminated bodies 103.

Next, an insulating film 107 is formed around an outer peripheral surface of each laminated body 103, and external electrodes 106*a* and 106*b* are formed on opposite end faces of the laminated body 103, so that a laminated coil 300 is completed. For example, the insulating film 107 is formed by applying thermosetting epoxy resin onto the outer peripheral surface of the laminated body 3 by dipping or printing and setting the epoxy resin with heat. For example, the external electrodes 106*a* and 106*b* are formed by dipping end portions of the laminated body 103 in conductive paste and baking the conductive paste applied on the end portions. Outer layers are sometimes further formed on the external electrodes 106*a* and 106*b* by plating.

Since the laminated coil 300 of the related art has the above-described structure, the size of the coil patterns can be increased to improve the coil characteristic without increasing the total size of the laminated coil 300.

SUMMARY

According to an embodiment, there is provided a laminated coil including a laminated body in which a plurality of insulating layers and a plurality of coil patterns are alternately and integrally stacked, a coil in the laminated body and including the coil patterns and connections between the coil patterns, a pair of external electrodes provided at opposite ends of the laminated body and connected to opposite ends of the coil, and an insulating film provided on an outer peripheral surface of the laminated body. At least one of the coil patterns is in contact with an outer peripheral edge of the corresponding insulating layer at least a part of an outer peripheral edge of the coil pattern, but is not in contact with corners of the insulating layer in a manner such that the coil-pattern is absent at portions of the corresponding insulating layer near the corners of the corresponding insulating layer.

Other features, elements, characteristics and advantages will become more apparent from the following detailed description of preferred embodiments with reference to the attached drawings.

DETAILED DESCRIPTION

Figure 6A:
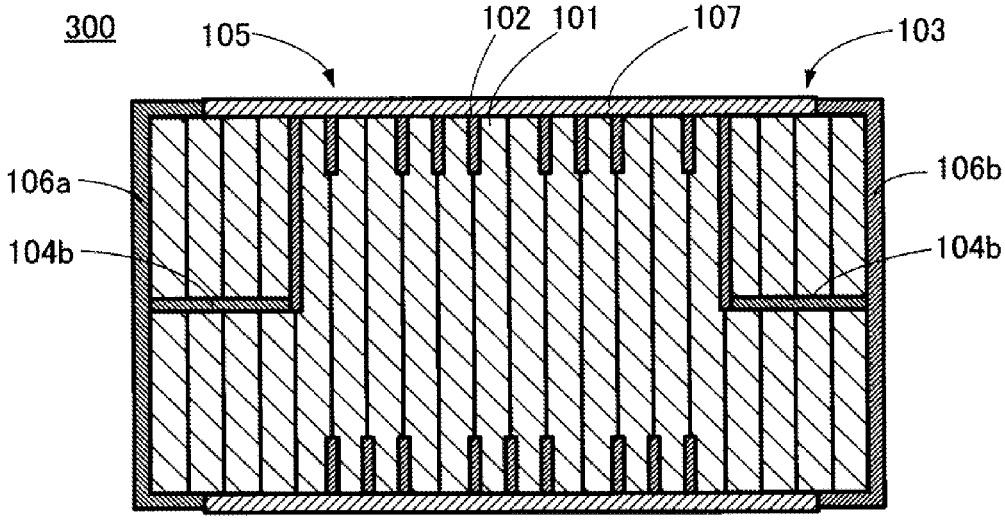
FIG.6A Prior Art
FIG. 6A is a cross-sectional view of the laminated coil of the related art, taken along chain line X-X of FIG. 5.
Figure 6B:
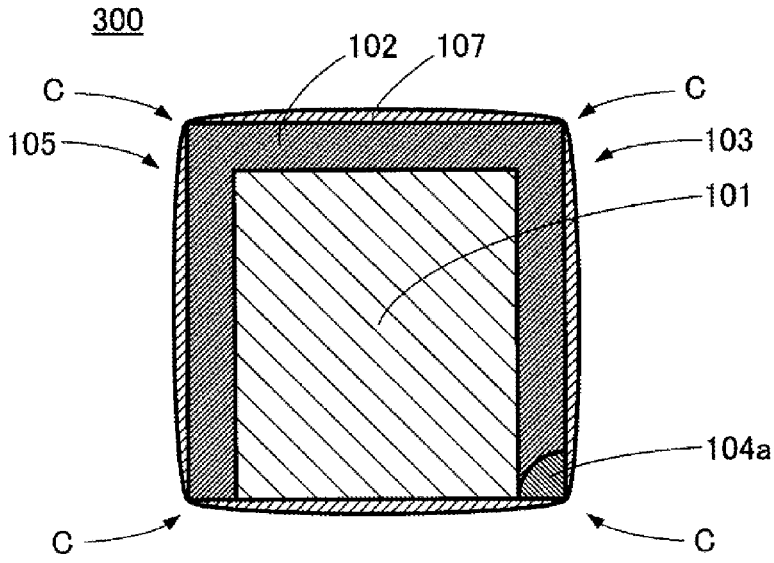
FIG.6B Prior Art
FIG. 6B is a cross-sectional view of the laminated coil of the related art, taken along chain line Y-Y of FIG. 5.
Figure 7:
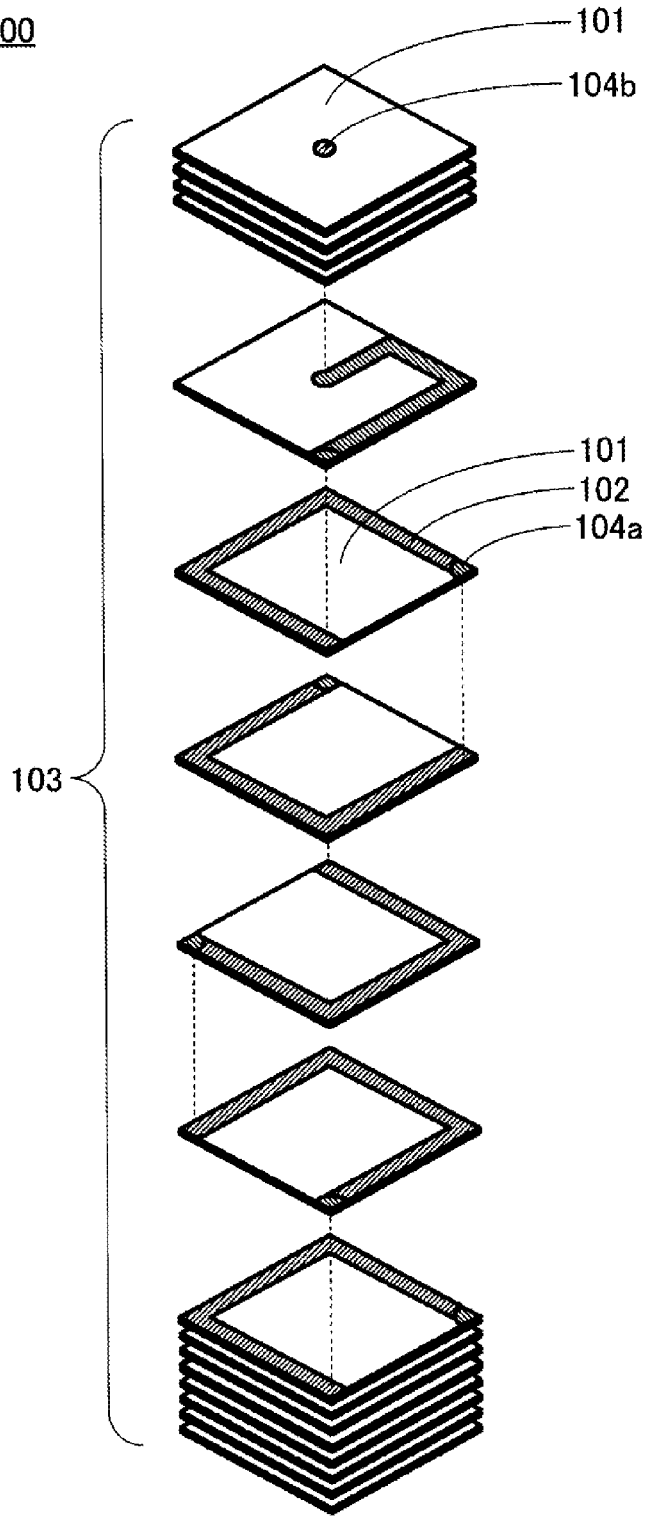
FIG.7 Prior Art
FIG. 7 is an exploded perspective view of the laminated coil of the related art, in which illustrations of external electrodes and an insulating film are not shown.

The inventors realized that the laminated coil 300 of the related art has a problem in that, although the insulating film 107 is provided around the outer peripheral surface of the laminated body 103 in the laminated coil 300, the insulating film 107 is not sufficiently attached on ridge portions of the laminated body 103. In other words, on four corners C of each of the insulating layers 101, as illustrated in FIG. 6B, and the coil patterns 102 are sometimes exposed outside. Although the insulating film 107 is formed, for example, by applying and setting epoxy resin with heat, as described above, the applied epoxy resin is sometimes moved to the center portions of the outer peripheral surface of the laminated body 103 by surface tension, and is insufficiently attached on the ridge portions of the laminated body 103.

If the coil patterns 102 are exposed from the insulating film 107 at the ridge portions of the laminated body 103, the laminated coil 300 becomes defective because of insufficient insulation. When the outer layers of the external electrodes 106*a* and 106*b* are formed by a plating method, plating glows in these portions, and this also sometimes makes the laminated coil 300 defective.

An exemplary embodiment that can address the above-described problems will now be described below with reference to FIGS. 1 to 3 of the drawings.

Figure 1:
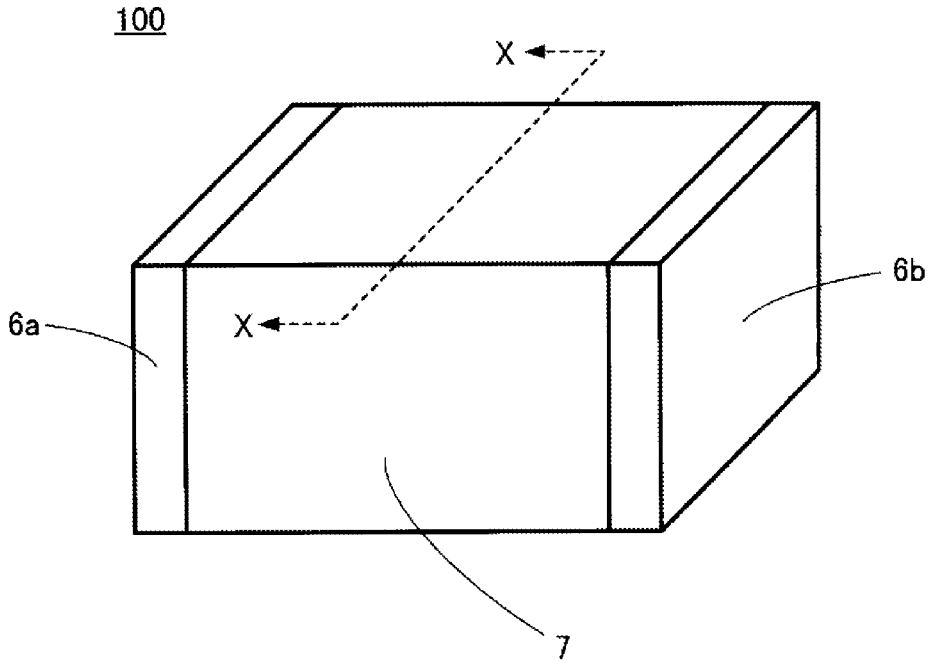
FIG. 1 is a perspective view of a laminated coil according to an exemplary embodiment.
Figure 2:
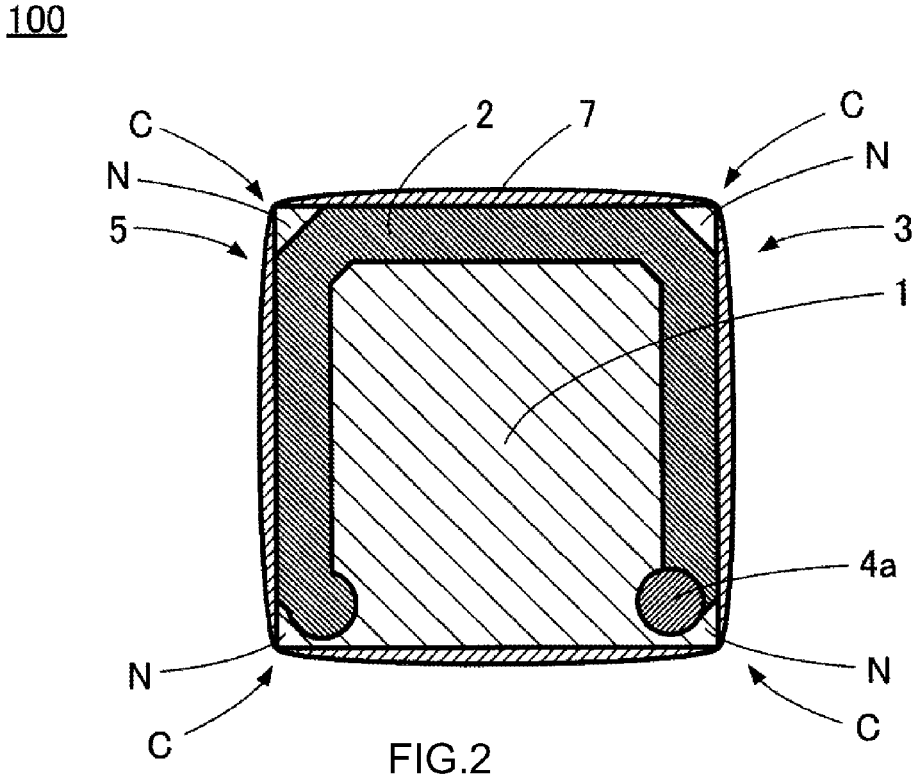
FIG. 2 is a cross-sectional view of the laminated coil of the embodiment, taken along chain line X-X of FIG. 1.
Figure 3:
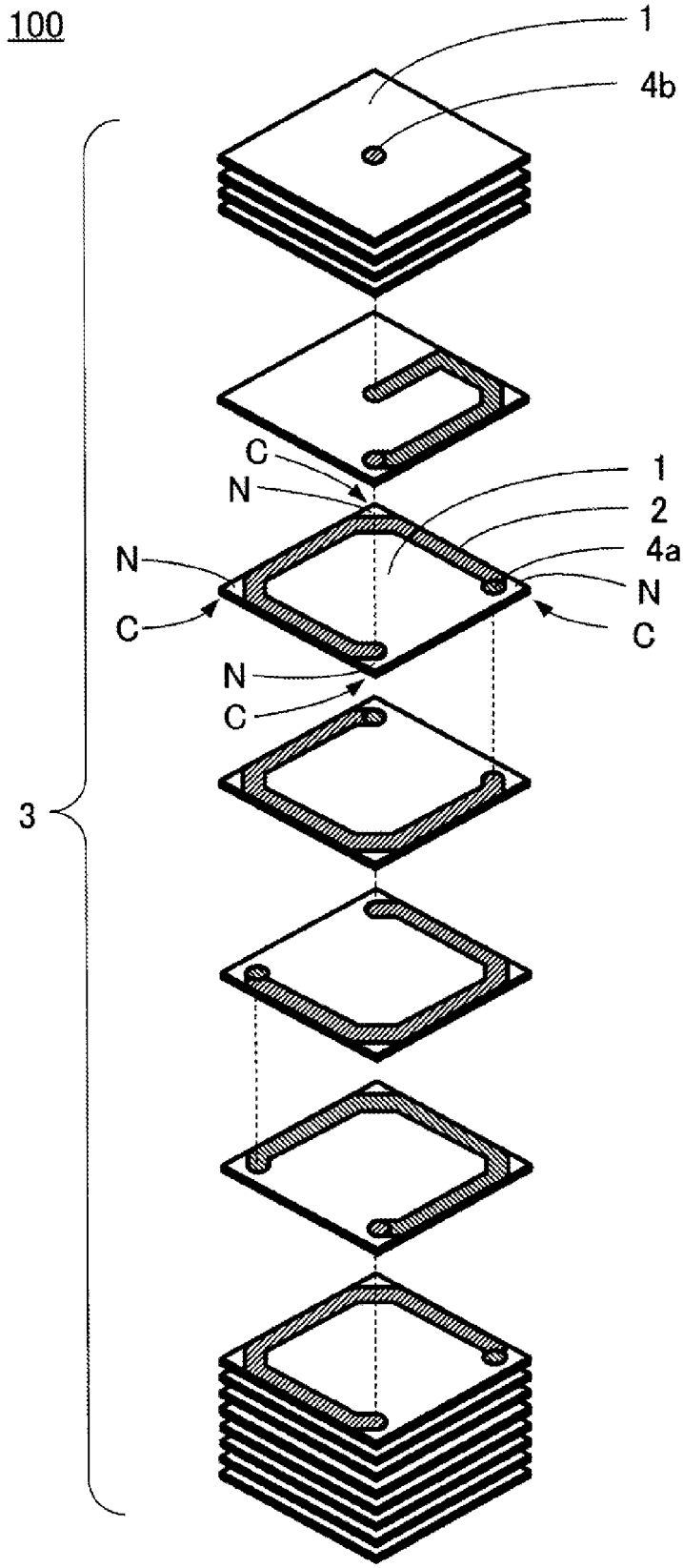
FIG. 3 is an exploded perspective view of the laminated coil of the exemplary embodiment, in which illustrations of external electrodes and an insulating film are not shown.

FIGS. 1 to 3 illustrate a laminated coil 100 according to an exemplary embodiment. FIG. 1 is a perspective view of the laminated coil 100, FIG. 2 is a cross-sectional view of the laminated coil 100, taken along chain line X-X of FIG. 1, and FIG. 3 is an exploded perspective view of the laminated coil 100. In FIG. 3, external electrodes 6*a* and 6*b* and an insulating film 7 are not shown.

As illustrated in FIGS. 1 to 3, the laminated coil 100 includes a laminated body 3 formed by alternately and integrally stacking substantially rectangular insulating layers 1 and substantially U-shaped coil patterns 2. While the size of the laminated body 3 can be arbitrarily determined, in this example it is about 0.6 mm in height, 1.0 mm in width, and 1.9 mm in length.

For example, the insulating layers 1 can be formed of a magnetic material, such as ferrite, or a nonmagnetic material such as a dielectric ceramic material. With the insulating layers 1 formed of a magnetic material, the laminated coil 100 serves as a magnetic-core coil. With the insulating layers 1 formed of a nonmagnetic material, the laminated coil 100 serves as an air-core coil. While the size of the insulating layers 1 can be arbitrarily determined, in this example it is about 0.6 mm in length, 1.0 mm in width, and 40 μm in thickness.

For example, the coil patterns 2 can be formed of silver, palladium, copper, gold, or silver palladium. While the width of the coil patterns 2 can be arbitrarily determined, in this example it is about 100 μm.

Outer peripheral edges of the coil patterns 2 are in contact with outer peripheral edges of the insulating layers 1. That is, there is no gap between the outer peripheral edges of the coil patterns 2 and the outer peripheral edges of the insulating layers 1. However, the coil patterns 2 are out of contact with four corners C of each of the insulating layers 1. That is, coil-pattern non-forming portions N are provided near the corners C of the insulating layers 1. The coil-pattern non-forming portions N are substantially shaped like an isosceles right triangle, for example. While the length of two equal sides of the isosceles right triangle can be arbitrarily determined, in this example it is about 80 μm. Preferably, the length of the two equal sides is more than or equal to about 50 μm, although depending on the thickness of an insulating film 7 that will be described below.

The coil patterns 2 are connected by via-hole conductors 4*a* provided through the insulating layers 1, whereby a coil 5 is formed in the laminated body 3. Near opposite ends of the laminated body 3, the coil patterns 2 are not stacked, but a plurality of insulating layers 1 are stacked, each having via-hole conductors 4*b* through which the coil 5 is led outside.

A pair of external electrodes 6*a* and 6*b* is provided at the opposite ends of the laminated body 3. The external electrode 6*a* is connected to one end of the coil 5, and the external electrode 6*b* is connected to the other end of the coil 5. For example, the external electrodes 6*a* and 6*b* can be formed of copper, silver, or nickel. Further, the external electrodes 6*a* and 6*b* do not need to be formed by a single layer, and can be formed by multiple layers made of different materials.

An insulating film 7 formed of an insulating resin, such as epoxy resin, is provided around an outer peripheral surface of the laminated body 3. Although depending on the size of the laminated body 3, for example, the thickness of the insulating film 7 is about 50 to 100 μm near the center portions of the outer peripheral surface of the laminated body 3, whereas the thickness of the insulating film 7 is smaller near ridge portions of the laminated body 3. In other words, the insulating film 7 smaller near the corners C of the insulating layers 1, similar to the related art. However, as described above, since the coil-pattern non-forming portions N are provided near the corners C of the insulating layers 1, the coil patterns 2 are not exposed from the side faces of the laminated body 3 in the coil-pattern non-forming portions N. Therefore, even when the thickness of the insulating film 7 is small in these portions, insulation performance of the laminated coil 100 will not degrade.

The laminated coil 100 of the embodiment having the above-described structure can be produced by the following exemplary method.

First, to produce multiple laminated coils 100 together, a plurality of mother green sheets (not illustrated) are prepared, which serve as bases of insulating layers 1. The mother green sheets are formed by shaping a slurry material into a sheet with a doctor blade or the like. The slurry material is formed by kneading a magnetic material or a nonmagnetic material, and a binder or the like.

Next, for a plurality of laminated coils 100, via-hole conductors 4*a* or 4*b* are formed in the mother green sheets, and coil patterns 2 are formed as required. For example, the via-hole conductors 4*a* and 4*b* are formed by filling holes that were preformed in the mother green sheets with conductive paste. For example, the coil patterns 2 are formed by applying conductive paste in a predetermined shape on surfaces of the mother green sheets by screen printing.

Next, the mother green sheets in which the predetermined via-hole conductors 4*a* and 4*b* and coil patterns 2 are formed are stacked in a predetermined order, pressed, and fired in a predetermined profile, so that a laminated body block including a plurality of laminated bodies 3 is formed.

Next, the laminated body block is cut into a plurality of laminated bodies 3. The laminated body block may be cut before the above-described firing step.

Next, an insulating film 7 is formed around an outer peripheral surface of each laminated body 3. For example, the insulating film 7 is formed by applying thermosetting epoxy resin onto the outer peripheral surface of the laminated body 3 by dipping or printing and setting the epoxy resin by heat.

Next, external electrodes 6*a* and 6*b* are formed on opposite end portions of the laminated body 3. For example, the external electrodes 6*a* and 6*b* are formed by dipping the end portions of the laminated body 3 in conductive paste and baking the conductive paste applied on the end portions. Outer layers may be further formed on the end portions by plating or by other methods. Formation of the insulating film 7 and formation of the external electrodes 6*a* and 6*b* on the laminated body 3 may be performed in reverse order.

While the laminated coil 100 according to the exemplary embodiment and the exemplary production method therefor have been described above, it will be understood that embodiments are not limited thereto and that various modifications can be made without departing from the scope of the disclosure.

For example, the shapes, sizes, numbers, etc. of the insulating layers 1 and the coil patterns 2 can be arbitrarily determined, and are not limited to the above examples.

In addition, in the above-described exemplary production method, the laminated coil 100 is formed by a sheet laminating method in which the coil patterns 2 are connected by the via-hole conductors 4*a*, the coil 5 is led out through the via-hole conductors 4*b*, and green sheets are used. In another exemplary embodiment, via-holes conductors can be eliminated by producing a laminated coil via a print laminating method in which insulating paste for insulating layers and conductive paste for coil patterns are alternately printed and superposed.

Figure 4:
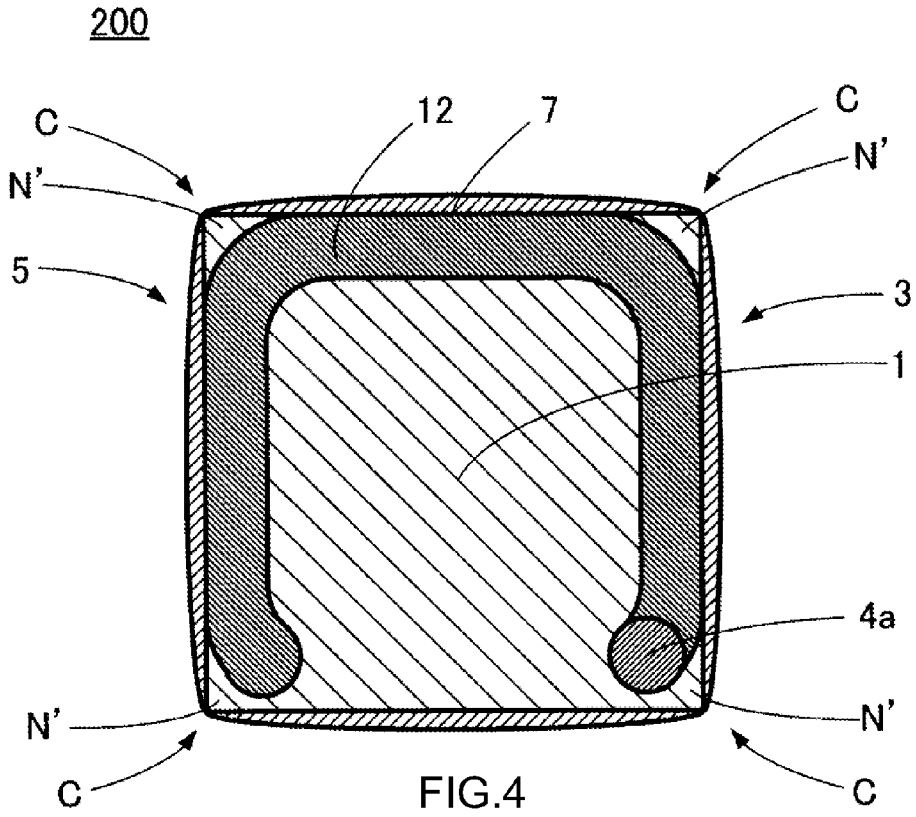
FIG. 4 is a cross-sectional view of a laminated coil according to a modified exemplary embodiment.
Figure 5:
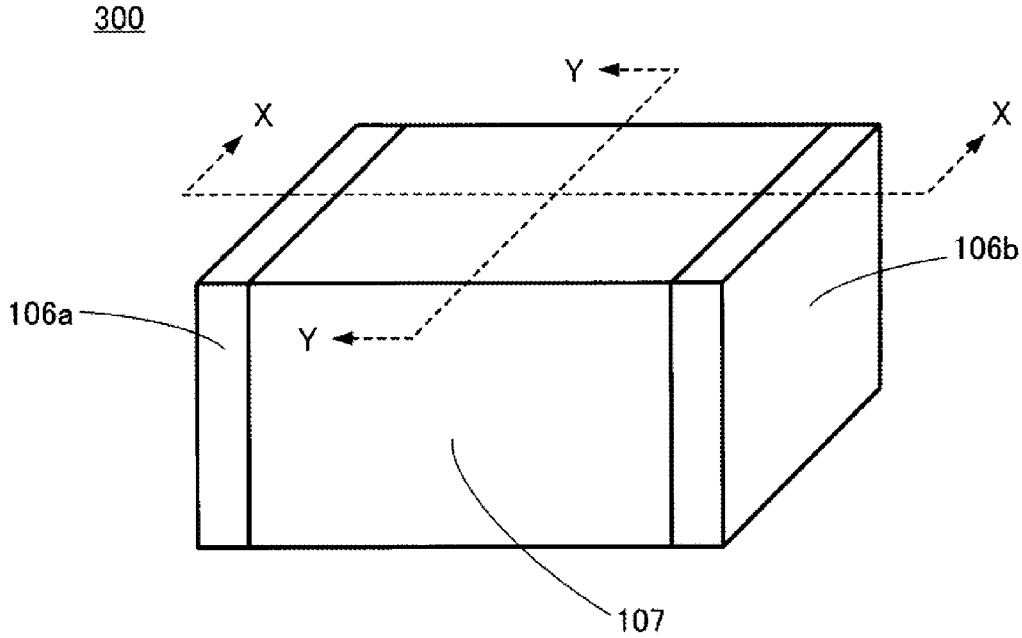
FIG.5 Prior Art
FIG. 5 is a perspective view of a laminated coil of the related art.

FIG. 4 is a cross-sectional view of a laminated coil 200 according to an exemplary modification. The laminated coil 200 is different in the shape of the coil patterns 2 from the laminated coil 100 of the above-described exemplary embodiment, but is similar in other portions.

That is, a coil pattern 12 in the laminated coil 200 is curved at inner and outer peripheral edges near four corners C of an insulating layer 1. In the laminated coil 200, the size of the coil pattern 12 can be further increased while ensuring a sufficient insulating performance with coil-pattern non-forming portions N'. This enhances the coil performance.

Because the laminated coil according to the disclosed embodiments has one of the above-described structure, the size of the coil patterns can be increased to improve the coil characteristic without increasing the total size of the laminated coil. Moreover, since the coil patterns are not exposed outside particularly at the ridge portions of the laminated body, insulation failure that makes the laminated coil defective does not occur.

By increasing the size of the coil patterns, the next coil characteristics can be improved. With the inner diameter and outer diameter of the coil patterns increased while maintaining the same width of the coil patterns in a magnetic-core laminated coil, the direct-current superposition characteristic of the coil can be improved. Also, with the inner diameter and outer diameter of the coil patterns increased while maintaining the same width of the coil patterns in an air-core laminated coil, the Q-value of the coil can be increased. Additionally, with the width of the coil patterns increased (outer diameter is increased) while maintaining the same inner diameter in the magnetic-core and air-core laminated coils, the direct-current resistance of the coil patterns can be reduced, and this increases the Q-value of the coil.

While preferred embodiments have been described above, it is to be understood that variations and modifications will be apparent to those skilled in the art without departing from the scope and spirit of the disclosure. The scope of the invention, therefore, is to be determined solely by the following claims and their equivalents.

What is claimed is:

1. A laminated coil comprising:

a laminated body in which plural insulating layers and plural coil patterns are alternately and integrally stacked;

a coil in the laminated body including the coil patterns and connections between the coil patterns;

a pair of external electrodes at opposite ends of the laminated body and connected to opposite ends of the coil; and an insulating film on an outer peripheral surface of the laminated body, wherein at least one of the coil patterns is in contact with an outer peripheral edge of the corresponding insulating layer at least a part of an outer peripheral edge of the coil pattern, but is not in contact with corners of the insulating layer in a manner such that the coil-pattern is absent at portions of the corresponding insulating layer near the corners of the corresponding insulating layer.

2. The laminated coil according to claim 1, wherein the insulating layers are formed of a magnetic material.

3. The laminated coil according to claim 1, wherein the insulating layers are formed of a nonmagnetic material.

4. The laminated coil according to claim 1, wherein the insulating film is formed of an insulating resin.

5. The laminated coil according to claim 2, wherein the insulating film is formed of an insulating resin.

6. The laminated coil according to claim 3, wherein the insulating film is formed of an insulating resin.

7. The laminated coil according to claim 1, wherein the coil patterns are connected by a via-hole conductor.

8. The laminated coil according to claim 2, wherein the coil patterns are connected by a via-hole conductor.

9. The laminated coil according to claim 3, wherein the coil patterns are connected by a via-hole conductor.

10. The laminated coil according to claim 4, wherein the coil patterns are connected by a via-hole conductor.

11. The laminated coil according to claim 5, wherein the coil patterns are connected by a via-hole conductor.

12. The laminated coil according to claim 6, wherein the coil patterns are connected by a via-hole conductor.

13. The laminated coil according to claim 1, wherein the insulating layers are substantially rectangular-shaped.

14. The laminated coil according to claim 13, wherein the at least one coil pattern is absent at four corners of the corresponding substantially rectangular-shaped insulating layer.

* * * * *